US007862968B2

(12) United States Patent
Nishina et al.

(10) Patent No.: US 7,862,968 B2
(45) Date of Patent: Jan. 4, 2011

(54) ELECTROPHOTOGRAPHIC PHOTORECEPTOR

(75) Inventors: Tsutomu Nishina, Tokyo (JP); Yoichi Nakamura, Nagano (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 751 days.

(21) Appl. No.: 11/661,204

(22) PCT Filed: Aug. 26, 2005

(86) PCT No.: PCT/JP2005/015547

§ 371 (c)(1),
(2), (4) Date: Sep. 14, 2007

(87) PCT Pub. No.: WO2006/030618

PCT Pub. Date: Mar. 23, 2006

(65) Prior Publication Data

US 2008/0160438 A1 Jul. 3, 2008

(30) Foreign Application Priority Data

Aug. 30, 2004 (JP) ..... 2004-250252
Dec. 17, 2004 (JP) ..... 2004-365572

(51) Int. Cl.
*G03G 5/04* (2006.01)

(52) U.S. Cl. ..... 430/58.05; 430/58.2

(58) Field of Classification Search ..... 430/58.05, 430/58.2

See application file for complete search history.

(56) References Cited

U.S. PATENT DOCUMENTS 5,204,202 A 4/1993 Ishikawa et al.
6,342,324 B1 * 1/2002 Li et al. ..... 430/67

FOREIGN PATENT DOCUMENTS

| | | |
|---|---|---|
| JP | 60-256149 | 12/1985 |
| JP | 02-242262 | 9/1990 |
| JP | 02-245767 | 10/1990 |
| JP | 04-152352 | 5/1992 |
| JP | 05-216266 | 8/1993 |
| JP | 05-341550 | 12/1993 |
| JP | 06-003848 | 1/1994 |
| JP | 08-305171 | 11/1996 |

(Continued)

OTHER PUBLICATIONS

Richard E. Lyon et al., "Combustibility of Cyanate Ester Resins", Jun. 2002, Final Report, DOT/FAA/AR-02/44, Office of Aviation Research.

(Continued)

*Primary Examiner*—Hoa V Le
(74) *Attorney, Agent, or Firm*—Rabin & Berdo, PC

(57) ABSTRACT

An electrophotographic photoreceptor includes an electroconductive substrate; and at least a photosensitive layer provided on the electroconductive substrate, wherein the electrophotographic photoreceptor has an outermost layer which contains microcapsules having a lubricating oil encompassed therein. The microcapsules may be composed of an inorganic porous particle or an organic polymer material, and the lubricating oil may be a silicone oil or a fluoro oil. Such a photoreceptor has a surface with excellent lubricity and is less susceptible to surface damage and filming from toner or the like while exhibiting good reuseability of toner.

21 Claims, 2 Drawing Sheets

FOREIGN PATENT DOCUMENTS

| | | | |
|---|---|---|---|
| JP | 10-171135 | | 6/1998 |
| JP | 10-239887 | | 9/1998 |
| JP | 2001-290295 | | 10/2001 |
| JP | 2002-182415 | A | 6/2002 |
| JP | 2002-244326 | | 8/2002 |
| JP | 2002-278122 | | 9/2002 |
| JP | 2003-043712 | A | 2/2003 |
| JP | 2003-255581 | A | 9/2003 |
| JP | 2003-316041 | | 11/2003 |
| JP | 2003-316055 | | 11/2003 |
| JP | 2004-101814 | | 4/2004 |
| JP | 2006-259168 | A | 9/2006 |

OTHER PUBLICATIONS

Foreign Office Action dated Nov. 2, 2010 with English translation.

* cited by examiner

ELECTROPHOTOGRAPHIC PHOTORECEPTOR

CROSS-RFFERENCE TO RELATED APPLICATIONS

This is the U.S. national stage of PCT/JP2005/015547, filed Aug. 26, 2005, which claims priority from JP application Ser. No. 2004-250252, filed Aug. 30, 2004, and from JP application Ser. No. 2004-365572, filed Dec. 17, 2004 and published Apr. 13, 2006 as JP 2006-099035 A.

BACKGROUND OF THE INVENTION

1. Field of the Invention

The present invention relates to an electrophotographic photoreceptor (hereinafter, sometimes simply referred to as a "photoreceptor"), and more specifically, relates to an electrophotographic photoreceptor applied to an image forming apparatus using an electrophotographic system, such as a printer, a copying machine and a facsimile machine.

2. Background of the Related Art

An electrophotographic photoreceptor has a basic structure containing an electroconductive substrate having provided thereon a photosensitive layer. As the electrophotographic photoreceptor, an organic electrophotographic photoreceptor using an organic photoconductive substance has been proposed in a large number of reports and is being applied to practical use from the standpoint of pollution prevention, reduction in cost, and flexibility of material selection, by which the characteristics of the photoreceptor can be variously designed.

A photosensitive layer of the organic photoreceptor contains a layer mainly having an organic photoconductive substance dispersed in a resin, and various proposals have been made, which include a layered structure containing a layer having a charge generating substance dispersed in a resin (charge generation layer) and a layer having a charge transporting substance dispersed in a resin (charge transport layer) laminated thereon, and a single layer structure having a charge generating substance and a charge transporting substance dispersed in a resin.

In general, an electrophotographic photoreceptor is required to have sensitivity, electrical characteristics and optical characteristics that are demanded in an electrophotographic process, to which the photoreceptor is applied. Furthermore, in a photoreceptor to be used repeatedly, the outermost layer of the photoreceptor, i.e., the layer farthest from the electroconductive substrate, is directly applied with electrical and mechanical external forces, such as corona charging, development with a toner, transfer to paper, and cleaning, and thus the layer is required to have durability thereto. Specifically, it is required to have durability to wear and formation of scratches on the surface due to friction with another member, and deterioration of the surface due to ozone formed upon corona charging. In particular, since the service life of the electrophotographic photoreceptor largely depends on wear of the surface thereof, it is necessary to suppress scratching of the surface layer. There is another problem of adhesion of toner (filming) on the surface of the photoreceptor due to repetition of development with a toner and cleaning. Filming should be prevented from occurring since an image defect occurs in an area where filming occurs. In order to prevent filming from occurring, it is necessary to improve the cleaning properties of the surface of the photoreceptor.

For this purpose, an attempt was made to add a lubricating component to a surface layer of a photoreceptor to improve the surface lubricating property and to reduce an adhesion force of toner to the surface, whereby the toner is prevented from adhering to suppress filming from occurring. However, when a liquid lubricant is used, it is poor in maintenance of its effect upon repeated use, and when a solid lubricant is used, it has problems in dispersibility and stability of a coating composition.

As a technique relating to improvement in surface properties of a photoreceptor, for example, JP-A-10-171135 discloses an electrophotographic photoreceptor having a photosensitive layer containing a prescribed silicone oil in a prescribed amount, so as to realize a photoreceptor that is excellent in wear resistance upon repeated use, is capable of reducing surface energy of the photoreceptor, and for which toner filming and background contamination is prevented. However, while the technique provides lubricating properties to the surface by dispersing silicone oil in the photosensitive layer, the silicone oil separates out on the surface of the photoreceptor and, thus, it is difficult to maintain the lubricating properties upon repeated use so that insufficient durability results.

It has been known to apply the technique of microcapsules to an electrophotographic photoreceptor. A microcapsule is a minute capsule having a size on the order of a micrometer. As a technique relating to a photoreceptor using microcapsules, JP-A-60-256149 discloses an electrophotographic photoreceptor having a photoconductive layer containing a powder of a phthalocyanine photoconductive material and a sensitizing agent, which have been microencapsulated with a resin, so as to improve the ozone resistance and the humidity resistance without deterioration in sensitivity.

JP-A-6-3848 discloses that upon forming a color image using photosensitive microcapsules containing a color toner, a light scattering material is attached to the photosensitive microcapsules in different amounts respectively, whereby an image having color reproducibility truthful to the original image can be obtained. JP-A-2001-290295 discloses addition of a wear preventing material which has been treated with a prescribed resin, preferably microencapsulated, to the outermost layer of a photoreceptor, whereby the wear resistance on the surface of the photoreceptor is improved, and the residual potential thereon is lowered.

JP-A-8-305171 discloses a developer carrying member having a one-component developer (toner) carried thereon, a thin film constituted by a binder resin and releasing agent-containing capsule particles containing a releasing agent as a core substance formed on the surface thereof. A developer carrying member results which provides improved wear resistance of the film on the surface of the developer carrying member, which is stable in surface roughness and charge imparting property to the toner, which is suppressed in occurrence of excessive charging of the toner and fusion of the toner onto the developer carrying member and a photoreceptor drum, and which is suppressed in occurrence of decrease in image density.

OBJECTS OF THE INVENTION

As described in the foregoing, various studies have been made for improvement in surface properties of a photoreceptor, but they are still insufficient, and a photoreceptor is being demanded that is excellent in wear resistance and suffers no filming problem.

An object of the invention is to solve the problems associated with the conventional art and to provide an electrophotographic photoreceptor that has an excellent lubricating property, that has a surface resistant to scratching and damage, that prevents image defects due to filming or the like from occurring, that has a good toner releasing property, and that has high durability.

SUMMARY OF THE INVENTION

As a result of earnest investigations made by the inventors for attaining the object, it has been found that these problems can be solved by using microcapsules having a lubricating oil encompassed therein dispersed in the outermost layer of the photoreceptor, and thus the invention has been completed.

The electrophotographic photoreceptor according to the invention contains an electroconductive substrate having thereon at least a photosensitive layer, characterized in that an outermost layer contains microcapsules having a lubricating oil encompassed therein.

The outermost layer referred to herein is the layer constituting the outer surface of the photoreceptor, i.e., the layer that is farthest from the electroconductive substrate. The photosensitive layer referred to herein includes both a layered type having a charge generation layer and a charge transport layer laminated, and a single layer type containing a charge generating substance and a charge transporting substance. The microcapsules having a lubricating oil encompassed therein include both microcapsules enclosing a lubricating oil and microcapsules which have adsorbed lubricating oil or which have been impregnated with a lubricating oil.

Advantages of the Invention

As described above, the invention uses microcapsules having a lubricating oil encompassed therein in the outermost layer of the photoreceptor. In the case where an ordinary lubricating oil in liquid form is simply added to the layer, as in the conventional technique, the lubricating oil separates out on the surface, and although a good lubricating property is obtained in the initial stage, the lubricating oil is lost when the surface is scratched upon repeated use and the lubricating property is not maintained. In the case where the microcapsules having a lubricating oil encompassed therein are added according to the invention, however, the lubricating oil can be dispersed not only to the surface of the outermost layer of the photoreceptor but also to the interior thereof, whereby the lubricating property can be stably maintained upon repeated use. Furthermore, the wear resistance can be improved to reduce scratching on the surface to improve the service life of the photoreceptor. Moreover, the surface energy can be reduced, by which prevention of adhesion of a toner on the surface of the photoreceptor is expected. Moreover, filming can be prevented from occurring, which is significantly effective for improvement in surface properties of the photoreceptor.

The application of the microcapsule technique to an electrophotographic photoreceptor has been variously investigated as described in the foregoing. However, no technique is known in which microcapsules having a lubricating oil encompassed therein are applied to a photoreceptor, and the lubricating oil is released by breaking the microcapsules to exhibit wear resistance of the surface of the photoreceptor. This is first found in the invention.

BRIEF DESCRIPTION OF THE DRAWINGS

FIGS. 1A to 1E are cross sectional views showing constitutional examples of the electrophotographic photoreceptor of the invention, in which FIG. 1A and FIG. 1B show constitutions of a negatively charged function-separated photoreceptor, FIG. 1C shows the constitution of a positively charged function-separated photoreceptor, and FIG. 1D and FIG. 1E show constitutions of a positively charged single layer photoreceptor;

DETAILED DESCRIPTION OF THE INVENTION

Preferred embodiments of the invention will be described in detail below with reference to the drawings.

Figure 1A:
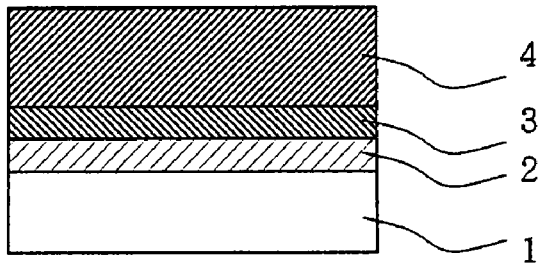
Figure 1B:
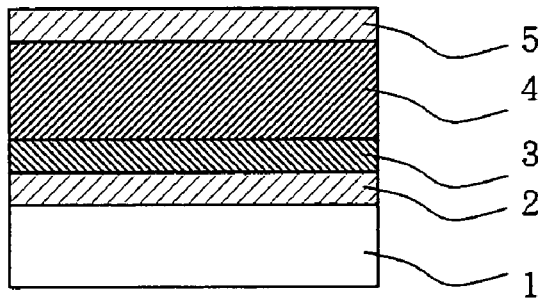
Figure 1C:
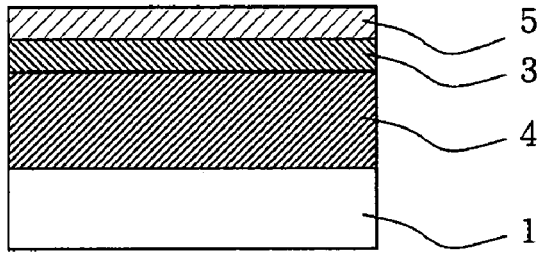
Figure 1D:
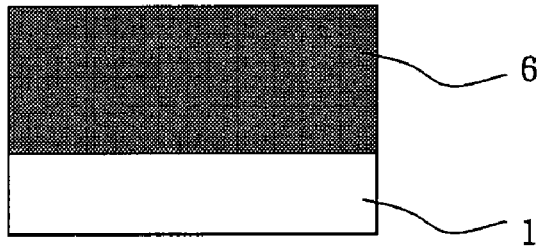
Figure 1E:
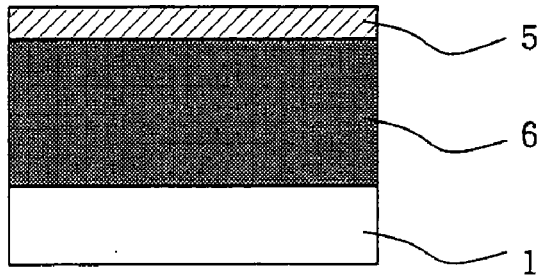

FIGS. 1A to 1E are conceptual cross sectional views showing constitutional examples of the photoreceptor according to the invention, in which numeral 1 denotes an electroconductive substrate, 2 denotes an undercoating layer, 3 denotes a charge generation layer, 4 denotes a charge transport layer, 5 denotes a surface protective layer, and 6 denotes a single layer photosensitive layer. As described in the foregoing, the photosensitive layer of the photoreceptor is roughly classified into a function-separated type (layered type) separated into a charge generation layer 3 and a charge transport layer 4 (FIGS. 1A to 1C), and a single layer type containing a charge generating substance and a charge transporting substance (FIGS. 1D and 1E). The photosensitive layer in FIGS. 1A and 1B is a negatively charged type having a charge generation layer 3 and a charge transport layer 4 laminated in this order. The photosensitive layer in FIG. 1C is a positively charged type having a charge transport layer 4 and a charge generation layer 3 laminated in this order as being contrary to the former. The photosensitive layer 6 in FIGS. 1D and 1E is mainly a positively charged type having a single layer structure. The surface protective layer in the invention is to protect the surface of the photosensitive layer physically and chemically, and is the outermost layer provided on the charge transport layer 4 in the layered type in FIG. 1B, the outermost layer provided on the charge generation layer 3 in the reversely layered type in FIG. 1C, and the outermost layer provided on the single layer photosensitive layer 6 in the single layer type in FIG. 1E. The outermost layer referred to herein includes the case where an outermost layer containing a charge transporting substance is provided.

It is important in the invention that the outermost layer of the photoreceptor contains microcapsules having a lubricating oil encompassed therein. Accordingly, for example, the charge transport layer 4 in the layer constitution shown in FIG. 1A, the surface protective layer 5 in the layer constitutions shown in FIGS. 1B, 1C and 1E, and the single layer photosensitive layer 6 in the layer constitution shown in FIG. 1(*d*) are the outermost layers, in which the microcapsules having a lubricating oil encompassed therein according to the invention are contained.

The material of the microcapsules according to the invention may be either an inorganic material or an organic material. Specific and preferred examples of the microcapsules formed of an inorganic material include those formed of inorganic porous particles, and hollow inorganic porous particles are particularly preferred. This is because a larger amount of the lubricating oil can be encompassed by the hollow inorganic porous particles. As the inorganic porous particles, porous silica particles are preferably used. The method for encompassing the lubricating oil in the microcapsules formed of the inorganic porous particles, i.e., the method for microencapsulating, is preferably a method of impregnating commercially available porous silica particles, which are available, for example, from Washin Chemical Industry Co., Ltd. and Suzuki Yushi Industrial Co., Ltd., with the lubricating oil under stirring.

Specific and preferred examples of the microcapsules formed of an organic material include those formed of an organic polymer material, and preferred examples of the organic polymer material include a melamine resin and a polystyrene resin. The method for encompassing the lubricating oil in the microcapsules formed of the organic polymer material may be various known methods, examples of which include an interface polymerization method, an in situ polymerization method, a submerged curing method, a phase separation method and a submerged drying method.

The particle diameter of the microcapsules may be, for example, about from 0.1 to 10 μm, and preferably about from 0.3 to 5 μm, while depending on the thickness of the outermost layer containing them. In the case where the particle diameter is too large, they might protrude from the layer surface to impair the surface property when the layer containing them is thin. In the case where the particle diameter is too small, on the other hand, the addition amount thereof should be increased to obtain the desired lubricating property, which impairs the efficiency.

The lubricating oil used in the invention is not particularly limited and is preferably a silicone oil and a fluorine oil. Specific and preferred examples of the silicone oil include dimethyl silicone oil and methyl phenyl silicone oil, and specific and preferred examples of the fluorine oil include a fluoroether oil.

In the case where the lubricating oil encompassed in the microcapsules is soluble in a solvent used for a coating composition for forming the outermost layer, the lubricating oil is not completely covered although it is microencapsulated, and if the lubricating oil is dissolved in the solvent, the lubricating oil is separated out on the surface upon coating and drying the outermost layer to impair the advantages of the invention. Accordingly, the lubricating oil is preferably insoluble in the coating composition for forming the outermost layer and, in particular, preferably insoluble in a chlorine solvent, a ketone solvent, an alcohol solvent, an ether solvent and an aromatic solvent, which are used in the coating composition for forming the outermost layer. Specifically, the lubricating oil is preferably insoluble, for example, in methanol, ethanol, isopropyl alcohol, acetone, methyl ethyl ketone, tetrahydrofuran and dichloromethane. Accordingly, a silicone oil and a fluorine oil are preferably used, for example, and, in particular, a fluorine oil is effective since it has substantially no solvent capable of dissolving it.

The specific constitutions of the layers will be described below in detail.

The electroconductive substrate 1 functions as both an electrode of the photoreceptor and a support of the layers, and may be in any shape including a cylindrical shape, a plate shape and a film shape, and the material therefore may be a metal, such as aluminum, stainless steel and nickel, and glass or a resin having an electroconductive treatment applied thereon.

The undercoating layer 2 may be a layer containing a resin as a major component or an oxide film, such as alumite, and is provided depending on necessity for such purposes as prevention of injection of unnecessary charge from the electroconductive substrate to the photosensitive layer, coating of defects on the surface of the substrate, and improvement in the adhesion property to the photosensitive layer. Examples of the resin binder used in the undercoating layer 2 containing a resin as a major component include polyethylene, polypropylene, polystyrene, an acrylic resin, a vinyl chloride resin, a vinyl acetate resin, a polyurethane resin, an epoxy resin, a polyester resin, a melamine resin, a silicone resin, a polybutyral resin a polyamide resin, and copolymers thereof, which may be used in combination. The resin binder may contain metallic oxide fine particles or the like. Examples of the metallic oxide fine particles include $SiO_2$, $TiO_2$, $In_2O_3$ and $ZrO_2$.

The thickness of the undercoating layer 2 may be arbitrarily set in such a range that causes no adverse effect, such as increase in residual potential upon repeated use, while depending on the formulation of the undercoating layer 2. In the layer constitutions shown in FIGS. 1A and 1B, the undercoating layer 2 may be omitted.

The charge generation layer 3 is formed by vacuum deposition of an organic photoconductive substance or by coating a material having particles of an organic photoconductive substance dispersed in a resin binder, and generates charge upon reception of light. It is important that the layer has a high charge generation efficiency simultaneously with the injection property of charge generated therein into the charge transport layer 4, and it is preferred to have a low electric field dependency and good injection property under a low electric field.

It is sufficient that the charge generation layer 3 has a charge generating function, and thus the thickness thereof is determined by the light absorption coefficient of the charge generating substance and is generally 5 μm or less, and preferably 1 μm or less. The charge generation layer 3 may contain a charge generating substance as a major component with a charge transporting substance or the like added thereto. Examples of the charge generating substance include a phthalocyanine pigment, an azo pigment, an anthanthrone pigment, a perylene pigment, a perynone pigment, a squalirium pigment, a thiapyrylium pigment and a quinacridone pigment, which may be used in combination. The phthalocyanine pigment is preferably nonmetallic phthalocyanine, copper phthalocyanine and titanyl phthalocyanine, and more preferably X-type nonmetallic phthalocyanine, τ-type nonmetallic phthalocyanine, ϵ-type copper phthalocyanine, β-type titanyl phthalocyanine, Y-type titanyl phthalocyanine, and titanyl phthalocyanine disclosed in JP-A-2004-2874 having a maximum peak in a CuKα X-ray diffraction spectrum at a Bragg angle 2θ of 9.6°.

Examples of the resin binder used in the charge generation layer 3 include a polycarbonate resin, a polyester resin, a polyamide resin, a polyurethane resin, an epoxy resin, a polybutyral resin, a vinyl chloride resin, a phenoxy resin, a silicone resin, a methyl methacrylate resin, and copolymers thereof, which may be used in combination.

The charge transport layer 4 is a coated film containing a material having a charge transporting substance dispersed in a resin binder, and it retains charge of the photoreceptor as a dielectric material layer in a dark place, and exhibits the function of transporting charge injected from the charge generation layer in a bright place.

Examples of the charge transporting substance include a hydrazone compound, a pyrazoline compound, a pyrazolone compound, an oxadiazole compound, an oxazole compound, an arylamine compound, a benzidine compound, a stilbene compound, a stylyl compound, and a charge transporting polymer, such as polyvinyl carbazole.

Examples of the resin binder used in the charge transport layer 4 include a polycarbonate resin, a polyester resin, a polystyrene resin, a polymer of a methyl methacrylate, and copolymers thereof, which may be used in combination.

The thickness of the charge transport layer 4 is preferably from 3 to 50 μm, and more preferably from 10 to 40 μm, for practically maintaining an effective surface potential.

The charge transport layer 4 may contain an electron acceptive substance depending on necessity for such purposes as improvement in sensitivity, reduction in residual potential, and decrease in fluctuation of characteristics upon repeated use. Examples of the electron acceptive compound include compounds having a large electron affinity, such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil and o-nitrobenzoic acid.

The charge transport layer 4 may contain a deterioration preventing agent, such as an antioxidant and a light stabilizer, for such purposes as improvement in environment resistance and stability to harmful light. Examples of the compound used for the purposes include a chromanol derivative, such as tocopherol, an esterified compound, a polyarylalkane compound, a hydroquinone derivative, an etherified compound, a dietherified compound a benzophenone compound, a benzotriazole derivative, a thioether compound, a phenylenediamine derivative, a phosphonate ester, a phosphite ester, a phenol compound, a hindered phenol compound, a linear amine compound, a cyclic amine compound and a hindered amine compound.

The charge transport layer 4 may contain a leveling agent, such as a silicone oil and a fluorine oil, for improving the leveling property of the formed film.

In the case where the charge transport layer 4 is the outermost layer in the invention, it is necessary that the charge transport layer 4 contains the microcapsules having a lubricating oil encompassed therein according to the invention for maintaining the lubricating property after repeated use. The content of the microcapsules in this case may be about from 0.1 to 50% by weight, and preferably about from 1 to 20% by weight, based on the solid content of the charge transport layer. In the case where the content is too small, the effect of improving the lubricating property cannot be sufficiently obtained, and in the case where it is too large, the original capability of the charge transport layer might be impaired.

The single layer photosensitive layer 6 is a coated film formed of a material having a charge generating substance and a charge transporting substance dispersed in a resin binder, and the materials used in the charge generation layer 3 and the charge transport layer 4 may be similarly used. The thickness thereof is preferably from 3 to 50 μm, and more preferably from 10 to 40 μm, for practically maintaining an effective surface potential.

The photosensitive layer 6 may contain an electron acceptive substance depending on necessity for such purposes as improvement in sensitivity, reduction in residual potential, and decrease in fluctuation of characteristics upon repeated use, as similar to the charge transport layer 4. Examples of the electron acceptive compound include compounds having a large electron affinity, such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil and o-nitrobenzoic acid.

The photosensitive layer 6 may contain a deterioration preventing agent, such as an antioxidant and a light stabilizer, for such purposes as improvement in environment resistance and stability to harmful light, as similar to the charge transport layer 4. Examples of the compound used for the purposes include a chromanol derivative, such as tocopherol, an etherified compound, an esterified compound, a polyarylalkane compound, a hydroquinone derivative, a dietherified compound a benzophenone compound, a benzotriazole derivative, a thioether compound, a phenylenediamine derivative, a phosphonate ester, a phosphite ester, a phenol compound, a hindered phenol compound, a linear amine compound, a cyclic amine compound and a hindered amine compound.

The photosensitive layer 6 may contain a leveling agent, such as a silicone oil and a fluorine oil, for improving the leveling property of the formed film, as similar to the charge transport layer 4.

In the case where the photosensitive layer 6 is the outermost layer in the invention, it is necessary that the photosensitive layer 6 contains the microcapsules having a lubricating oil encompassed therein according to the invention for maintaining the lubricating property after repeated use. The content of the microcapsules in this case may be about from 0.1 to 50% by weight, and preferably about from 1 to 20% by weight, based on the solid content of the photosensitive layer 6. In the case where the content is too small, the effect of improving the lubricating property cannot be sufficiently obtained, and in the case where it is too large, the original capability of the photosensitive layer might be impaired.

The surface protective layer 5 is generally constituted by such a substance that is excellent in lubricating property, is excellent in durability to mechanical stress, and is chemically stable. The surface protective layer 5 has a function of receiving and retaining charge of corona discharge in a dark place, and also has a function of transmitting light, to which the charge generation layer 3 is sensitive. Accordingly, the light is transmitted through the surface protective layer 5 upon exposure to reach the charge generation layer 3, and the surface protective layer 5 receives the charge thus formed, so as to neutralize and negate the surface charge. The material used therefore is transparent as much as possible at the wavelength region of the absorption maximum of the charge generating substance, as described above. The thickness of the surface protective layer 5 may be arbitrarily determined within a range where no adverse affect, such as increase in residual potential, occurs upon repeated use, and is, for example, about from 0.1 to 10 μm, and preferably from 1 to 8 μm.

The surface protective layer 5 may be provided in the forms shown in FIGS. 1B, 1C and 1E, and is not essential in the invention. The surface protective layer 5 is necessarily the outermost layer when it is provided. Accordingly, it is necessary that the surface protective layer 5 is formed of a material containing the microcapsules having a lubricating oil encompassed therein according to the invention for maintaining the lubricating property after repeated use.

The constitutional materials of the surface protective layer 5 necessarily include a resin binder in addition to the microcapsules having a lubricating oil encompassed therein, and may further include one or both of a reinforcing filler and a conductivity adjusting agent depending on necessity.

The resin binder used in the surface protective layer 5 is preferably a hardening resin, and particularly a thermosetting resin and a photocuring resin are effectively used. Specific and preferred examples thereof include a thermosetting resin, such as an epoxy resin, a urethane resin, and a hardened product of a cyanate ester (which is also referred to as a cyanate resin).

The epoxy resin is suitably an alkoxy group-containing silane-modified epoxy resin, and specific and preferred examples thereof include a hardened product of a hybrid material of an epoxy resin, which is obtained by the dealcoholization condensation reaction of a bisphenol type epoxy resin or a novolac type epoxy resin with an alkoxysilane partial condensate, with an alkoxysilane. Specific and preferred examples of the alkoxy group-containing silane-modified epoxy resin include resins having a structure represented by the following general formula (1) or (2):

(1)

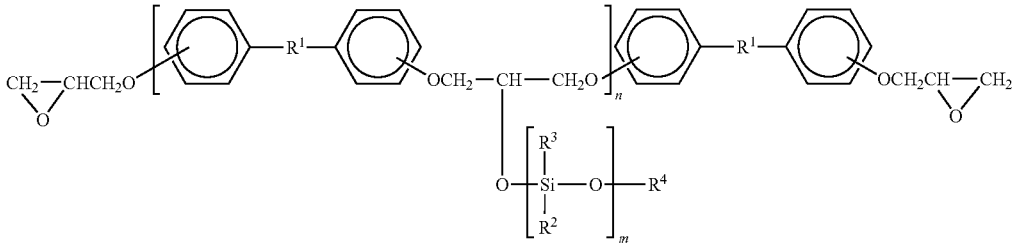

wherein $R^1$ represents $CH_2$, $C(CH_3)_2$, $CH(CH_3)$, $C(CF_3)_2$, O, $SO_2$ or S; $R^2$ and $R^3$ each independently represents an alkoxy group having from 1 to 3 carbon atoms or an alkyl group having 1 or 2 carbon atoms; $R^4$ represents an alkyl group having 1 or 2 carbon atoms; n represents an integer of from 0 to 100; and m represents an integer of from 1 to 20, (2)

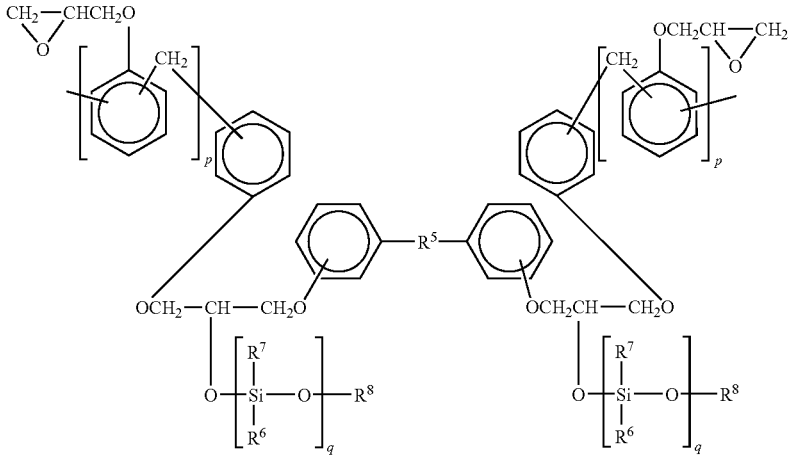

wherein $R^5$ represents $CH_2$, $C(CH_3)_2$, $CH(CH_3)$, $C(CF_3)_2$, O, $SO_2$ or S; $R^6$ and $R^7$ each independently represents an alkoxy group having from 1 to 3 carbon atoms or an alkyl group having 1 or 2 carbon atoms; $R^8$ represents an alkyl group having 1 or 2 carbon atoms; p represents an integer of from 0 to 100; and q represents an integer of from 1 to 20. Specific examples thereof include resins represented by the following formulae (1-1) and (2-1):

(1-1)

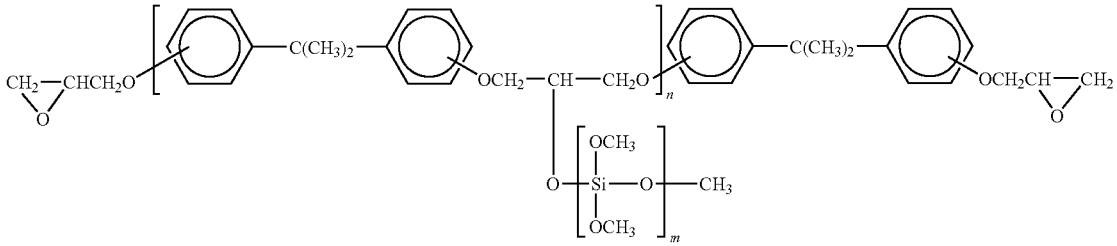

(2-1)

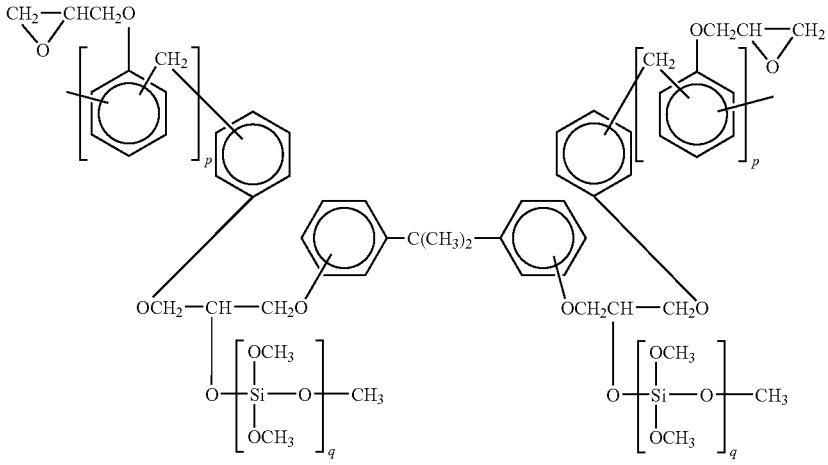

An epoxy resin is generally insufficient in strength and is poor in lubricating property for the resin itself, whereby it is largely scratched on the surface thereof and fails to provide sufficient durability. An epoxy resin is also liable to be attached by toner, whereby it is liable to suffer filming. On the other hand, the alkoxy group-containing silane-modified epoxy resin has a large strength to provide such an advantage that surface scratching can be reduced. In particular, the aforementioned hardened product of a hybrid material of an epoxy resin with an alkoxysilane has a considerably strong structure owing to the combination of the crosslinking with an epoxy group of the epoxy resin and the crosslinking through condensation of the alkoxysilane, whereby surface scratching can be suppressed. Furthermore, the adhesion of a toner can be suppressed owing to the small surface energy of the resin. The alkoxy group-containing silane-modified epoxy resin has such characteristics that toner hardly remains on the surface thereof to prevent filming from occurring, and the resin suffers less surface scratching, whereby the resin is effective as the resin binder of the surface protective layer 5.

The alkoxy group-containing silane-modified epoxy resin may effectively contain a hardening agent and a hardening accelerator for the epoxy resin part, and a hardening accelerator for the alkoxy silane part, depending on necessity. Examples of the hardening agent for the epoxy resin part include an acid anhydride and an amine, and examples of the hardening accelerator therefore include a tertiary amine. Examples of the hardening accelerator for the alkoxy silane part include a metallic complex of tin octylate.

In the invention, the proportion of the alkoxysilane part in the hybrid material of the epoxy resin with the alkoxysilane is preferably from 10 to 50% by weight. In the case where the proportion of the alkoxysilane part is less than 10% by weight, the amount of the crosslinked part through condensation of the alkoxysilane part is decreased and fails to obtain the reinforcing effect of the epoxy resin. In the case where the proportion thereof exceeds 50% by weight, the crosslinking density is excessively large, which increased the scratched amount of the surface of the photoreceptor.

The urethane resin is preferably those containing a fluorine-containing polyol. A urethane resin is liable to be attached by a toner owing to the large surface energy thereof to cause filming, but in the case where a urethane resin is hardened with a fluorine-containing polyol, the surface energy thereof can be reduced to suppress filming from occurring. A urethane resin also has the advantage that the resin is hardly scratched owing to the large ductility thereof.

Preferred examples of the hardened product of a cyanate ester include a polymer obtained by hardening a cyanate ester compound represented by the following general formula (3):

$$R^9\text{-}[O\text{-}C\equiv N]_r \tag{3}$$

wherein $R^9$ represents an aromatic organic group; and r represents an integer of 2 or 3, and in particular, a cyanate ester compound having a bisphenol skeleton and a bifunctional cyanate ester and represented by the following general formula (4):

(4)

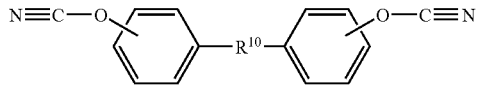

wherein $R^{10}$ represents $CH_2$, $C(CH_3)_2$, $CH(CH_3)$, $C(CF_3)_2$, O, $SO_2$ or S. The polymer having a bisphenol skeleton is advantageous in strength.

Specific examples of the cyanate ester represented by the general formula (4) include compounds represented by the following formulae (4-1) to (4-3):

(4-1)

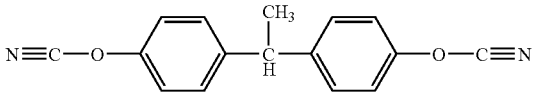

(4-2)

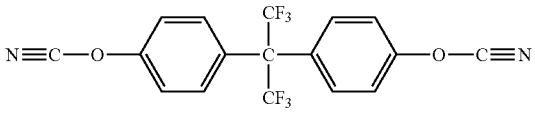

-continued (4-3)

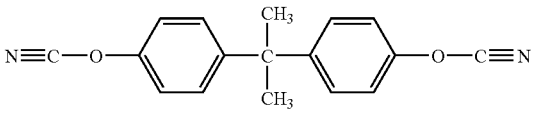

(4-4)

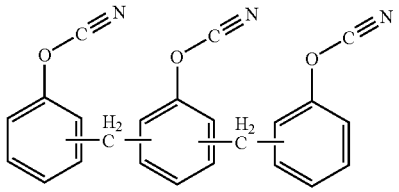

The compound represented by the formula (4-4) is also preferred. The hardened product of a cyanate ester is hardly scratched and damaged owing to the high hardness and the large strength thereof. It also has a small surface energy owing to the symmetrical structure to provide the advantage that toner is hardly attached which suppresses filming from occurring. It is effective that the cyanate ester is added with a an organic metallic compound, such as zinc octylate, tin octylate, acetylacetone zinc, acetylacetone iron and dibutyltin dimaleate, a metallic salt, such as aluminum chloride, tin chloride and zinc chloride, and an amine compound, such as triethylenediamine and dimethybenzylamine, as a catalyst depending on necessity.

The hardening resins are also advantageous in that an alcohol solvent, such as methanol, can be used mainly as a dilution solvent for the coating composition, whereby the extent of dissolving the surface of the photosensitive layer as an underlayer with the solvent is small. The hardening resins may be used solely or may be used in combination with another hardening resin with no particular limitation.

Specific and effective examples of the reinforcing filler used in the invention include inorganic fibers (whiskers), organic fibers, crosslinked acrylic resin fine particles, crosslinked polystyrene fine particles, high molecular weight polyethylene fine particles, polyimide fine particles and methylsilicone resin fine particles, but the invention is not limited thereto. The reinforcing filler may be dispersed in the resin binder, whereby the surface protective layer 5 can be improved in strength, hardness and ductility, and the friction coefficient on the surface thereof can also be reduced.

Examples of the conductivity adjusting agent added to the surface protective layer 5 in the invention include metallic oxide fine particles, metal fine particles, polymer fine particles coated with an electroconductive substance, and a charge transporting substance.

The content of the microcapsules in the surface protective layer 5 may be about 0.1 to 50% by weight, preferably about from 1 to 20% by weight, and more preferably about from 5 to 15% by weight, based on the solid content of the surface protective layer 5. In the case where the content is too small, the effect of improving the lubricating property cannot be sufficiently obtained, and in the case where it is too large, the original capability of the surface protective layer might be impaired.

EXAMPLES

Examples of the electrophotographic photoreceptor of the invention will be described. In the following description, all "parts" mean "parts by weight".

Preparation of Microcapsules having Lubricating Oil encompassed therein

Preparation Example 1

Microcapsules having various kinds of lubricating oils, produced by Japan Capsular Products Co., Ltd., were prepared. The material of the microcapsules was a melamine resin, and the particle diameter thereof was from 3 to 5 μm. Microcapsules using TSF 451 (dimethylsilicone oil, produced by GE Toshiba Silicone Co., Ltd.) as a lubricating oil were designated as microcapsules A, and microcapsules using J25 FLUID (fluoroether oil, produced by NOK Corp.) as a lubricating oil were designated as microcapsules B.

Preparation Example 2

Microcapsules were prepared by impregnating, in Washin Chemical Industry Co., Ltd., Washin Microcapsules (hollow porous silica particles, particle diameter: 2 to 5 μm), produced by Washin Chemical Industry Co., Ltd., with various kinds of lubricating oils. Microcapsules using TSF 451 (dimethylsilicone oil, produced by GE Toshiba Silicone Co., Ltd.) as a lubricating oil were designated as microcapsules C, and microcapsules using J25 FLUID (fluoroether oil, produced by NOK Corp.) as a lubricating oil were designated as microcapsules D.

Preparation Example 3

Microcapsules were prepared by impregnating SX866(A) (hollow crosslinked polystyrene particles, particle diameter: 0.3 μm), produced by JSR Corp., with various kinds of lubricating oils. Microcapsules using TSF 451 (dimethylsilicone oil, produced by GE Toshiba Silicone Co., Ltd.) as a lubricating oil were designated as microcapsules E, and microcapsules using J25 FLUID (fluoroether oil, produced by NOK Corp.) as a lubricating oil were designated as microcapsules F.

Preparation of Resin Binder Solution

Preparation Example 4

75 parts of an epoxy resin/alkoxysilane hybrid material (Compoceran E102, a trade name, produced by Arakawa Chemical Industries, Ltd., represented by the general formula (1), $R^1$: $C(CH_3)_2$, $R^2$: $OCH_3$, $R^3$: $OCH_3$, $R^4$: $CH_3$, specific example (1-1)), 9 parts of an acid anhydride (Rikacid HM-700, a trade name, produced by New Japan Chemical Co. Ltd.) as a hardening agent, 0.8 part of tin octylate and 0.4 part of DBU (1,8-diazabicyclo(5,4,0)undecene-7) as accelerating agents, and 100 parts of methanol and 50 parts of methyl ethyl ketone as solvents were weighed and mixed to obtain a resin binder solution A.

Preparation Example 5

18 parts of an HDI derivative block isocyanate (Duranate MF-K-60X, a trade name, produced by Asahi Kasei Chemicals Corp.), 30 parts of a fluorine-containing polyol (Lumiflon LF-200, a trade name, produced by Asahi Glass Co., Ltd.) and 50 parts of methyl ethyl ketone as a solvent were weighed and mixed to obtain a resin binder solution B.

Preparation Example 6

55 parts of a bisphenol E type cyanate ester (Arocy L-10, a trade name, produced by Vantico AG, compound represented by formula (4-1)), 0.3 part of zinc acetylacetonate as a catalyst and 180 parts of methyl ethyl ketone as a solvent were weighed and mixed to obtain a resin binder solution C.

Preparation Example 7

60 parts of a phenol resin (PR-912, a trade name, produced by Sumitomo Bakelite Co., Ltd.) and 100 parts of isopropyl alcohol as a solvent were weighed and mixed to obtain a resin binder solution D.

Preparation Example 8

15 parts of a bisphenol Z type polycarbonate resin (Panlite TS2050, a trade name, produced by Teijin Chemicals Ltd.) and 400 parts of methylene chloride as a solvent were weighed and mixed to obtain a resin binder solution E.

Preparation Example 9

60 parts of an epoxy resin (THB9502, a trade name, produced by Kyocera Chemical Corp.) and 100 parts of xylene as a solvent were weighed and mixed to obtain a resin binder solution F.

Preparation Example 10

75 parts of an epoxy resin/alkoxysilane hybrid material (Compoceran E112, a trade name, produced by Arakawa Chemical Industries, Ltd., represented by the general formula (2), $R^5$: $C(CH_3)_2$, $R^6$: $OCH_3$, $R^7$: $OCH_3$, $R^8$: $CH_3$, specific example (2-1)), 9 parts of an acid anhydride (Rikacid HM-700, a trade name, produced by New Japan Chemical Co. Ltd.) as a hardening agent, 0.8 part of tin octylate and 0.4 part of DBU (1,8-diazabicyclo(5,4,0)undecene-7) as accelerating agents, and 100 parts of methanol and 50 parts of methyl ethyl ketone as solvents were weighed and mixed to obtain a resin binder solution G.

Example 1

A drum photoreceptor (diameter: 30 mm) was produced in the following manner for evaluating the electric characteristics.

A dispersion liquid for an undercoating layer having the following formulation was dip-coated on an aluminum tube and dried at 100° C. for 30 minutes to remove the solvent, whereby an undercoating layer having a thickness of 3 μm was obtained.

Formulation of Dispersion Liquid for Undercoating Layer:

| | |
|---|---|
| Resin binder (alcohol solubilized nylon, CM8000, produced by Toray Industries, Ltd.) | 5 parts |
| Additive (titanium oxide fine particles treated with aminosilane) | 5 parts |
| Solvent (mixed solvent of methanol and methylene chloride (6/4 by volume)) | 90 parts |

A dispersion liquid for a charge generation layer having the following formulation was then dip-coated thereon and dried at 100° C. for 30 minutes to remove the solvent, whereby a charge generation layer having a thickness of 0.3 μm was obtained.

Formulation of Dispersion Liquid for Charge Generation layer:

| | |
|---|---|
| Charge generating substance (titanyl phthalocyanine) | 11 parts |
| Resin binder (vinyl chloride copolymer resin, MR-110, produced by Nippon Zeon Co., Ltd.) | 1 part |
| Solvent (methylene chloride) | 98 parts |

A dispersion liquid for a charge transport layer having the following formulation was then dip-coated thereon and dried at 100° C. for 30 minutes to remove the solvent, whereby a charge transport layer having a thickness of 20 μm was obtained.

Formulation of Dispersion Liquid for Charge Transport layer:

| | |
|---|---|
| Charge transporting substance (hydrazone compound, CTC191, produced by Takasago International Corp.) | 9 parts |
| Charge transporting substance (butadiene compound, T405, produced by Takasago International Corp.) | 1 part |
| Resin binder (bisphenol Z type polycarbonate resin, Panlite TS2050, produced by Teijin Chemicals Ltd.) | 10 parts |
| Solvent (methylene chloride) | 90 parts |

A dispersion liquid for a surface protective layer having the following formulation was then dip-coated thereon and dried at 80° C. for 30 minutes and further at 110° C. for 1 hour to remove the solvent, whereby a surface protective layer having a thickness of 4 μm was obtained.

Formulation of Dispersion Liquid for Surface Protective Layer:

| | |
|---|---|
| Resin binder (resin binder solution A (Preparation Example 4)) | 235.2 parts |
| Microcapsules having lubricating oil (microcapsules A (Preparation Example 1)) | 20 parts |
| Conductivity adjusting agent (tin oxide, Nano Tek Powder $SnO_2$, produced by C.I. Kasei Co., Ltd.) | 20 parts |

Thus, an electrophotographic photoreceptor was completed.

Examples 2 to 14

Electrophotographic photoreceptors were produced in the same manner as in Example 1 except that the combination of the resin binder solution A and the microcapsules A in the dispersion liquid for a surface protective layer and the mixing amount of tin oxide in Example 1 were changed to those shown in Table 1, and the drying conditions of 80° C. for 30 minutes and 110° C. for 1 hour were changed to those shown in Table 1.

Examples 15 and 16

Electrophotographic photoreceptors were produced in the same manner as in Examples 1 and 7, respectively, except that 15 parts of crosslinked polystyrene (SX8742, diameter: 0.3 μm, produced by JSR Corp.) as a reinforcing filler was added to the dispersion liquids for a surface protective layer in Examples 1 and 7.

Comparative Examples 1 to 3

Electrophotographic photoreceptors were produced in the same manner as in Examples 1 to 3 except that the microcapsules A were not added to the dispersion liquid for a surface protective layer in Examples 1 to 3.

Comparative Example 4

An electrophotographic photoreceptor was produced in the same manner as in Example 1 except that 7 parts of a dimethyl silicone oil (TSF451, produced by GE Toshiba Silicone Co., Ltd.) was added to the dispersion liquid for a surface protective layer in Example 1 instead of the microcapsules A.

Comparative Example 5

An electrophotographic photoreceptor was produced in the same manner as in Example 1 except that no surface protective layer was provided.

The formulations of the surface protective layers and the drying conditions of Examples and Comparative Examples are shown in Table 1 below.

TABLE 1

| | Resin binder solution (Preparation Examples 4 to 10) | | Microcapsules (Preparation Examples 1 to 3) | | Conductivity adjusting agent (tin oxide) | Other additive kind | |
|---|---|---|---|---|---|---|---|
| | Kind | Part | Kind | Part | part | (part) | Drying condition |
| Example 1 | A | 235.2 | A | 20 | 20 | — | 80° C. 30 min + 110° C. 1 hr |
| Example 2 | B | 98 | A | 11 | 15 | — | 110° C. 1 hr |
| Example 3 | C | 235.3 | A | 20 | 30 | — | 130° C. 1 hr |
| Example 4 | A | 235.2 | B | 20 | 20 | — | 80° C. 30 min + 110° C. 1 hr |
| Example 5 | B | 98 | B | 11 | 15 | — | 110° C. 1 hr |
| Example 6 | C | 235.3 | B | 20 | 30 | — | 130° C. 1 hr |
| Example 7 | A | 235.2 | C | 20 | 20 | — | 80° C. 30 min + 110° C. 1 hr |
| Example 8 | A | 235.2 | D | 20 | 20 | — | 80° C. 30 min + 110° C. 1 hr |
| Example 9 | A | 235.2 | E | 20 | 20 | — | 80° C. 30 min + 110° C. 1 hr |
| Example 10 | A | 235.2 | F | 20 | 20 | — | 80° C. 30 min + 110° C. 1 hr |
| Example 11 | D | 160 | A | 20 | 30 | — | 120° C. 1 hr |
| Example 12 | E | 415 | A | 6 | 9 | — | 90° C. 1 hr |
| Example 13 | F | 160 | A | 20 | 30 | — | 110° C. 1 hr |
| Example 14 | G | 235.2 | A | 20 | 20 | — | 80° C. 30 min + 110° C. 1 hr |
| Example 15 | A | 235.2 | A | 20 | 20 | SX8742 (15) | 80° C. 30 min + 110° C. 1 hr |
| Example 16 | A | 235.2 | C | 20 | 20 | SX8742 (15) | 80° C. 30 min + 110° C. 1 hr |
| Comparative Example 1 | A | 235.2 | — | — | 20 | — | 80° C. 30 min + 110° C. 1 hr |
| Comparative Example 2 | B | 98 | — | — | 15 | — | 110° C. 1 hr |
| Comparative Example 3 | C | 235.3 | — | — | 30 | — | 130° C. 1 hr |
| Comparative Example 4 | A | 235.2 | — | — | 20 | TSF451 (7) | 80° C. 30 min + 110° C. 1 hr |
| Comparative Example 5 | no surface protective layer | | | | | | |

The photoreceptors produced in Examples and Comparative Examples were evaluated for friction coefficient as an index of lubricating property, film scratched amount as an index of printing durability, and occurrence of filming as an index of image defects. The results are shown in Table 2 below.

Evaluation Methods

Figure 2:
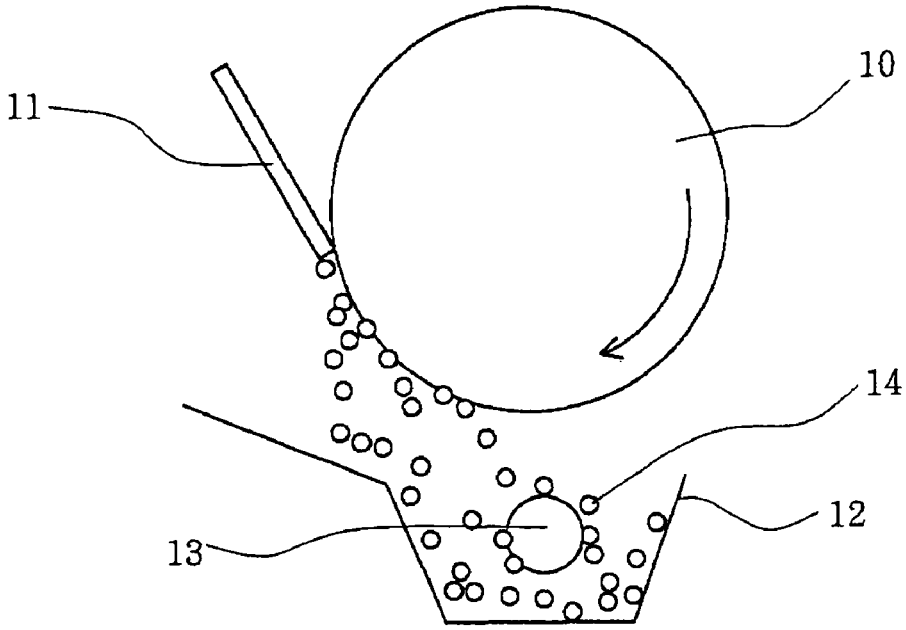
FIG. 2 is a schematic illustrative view showing an evaluation apparatus for printing durability used in the examples.

The evaluation of printing durability was carried out by using an apparatus shown in FIG. 2, in which a urethane cleaning blade 11, produced by Hokushin Corp., a toner box 12 and a toner charging roller 13 were disposed around a photosensitive drum (photoreceptor) 10, as a simulation of an actual apparatus. Specifically, the cleaning blade 11 was made in contact with the photosensitive drum 10 at a pressure-contact angle of 25°, and the photosensitive drum 10 was rotated at a rotation speed of 210 rpm (100,000 revolutions). The film scratched amount on the surface of the photosensitive drum 10 with the cleaning blade 11 was evaluated as an index of printing durability. In FIG. 2, symbol 14 denotes a magnetic one-component toner.

Figure 3:
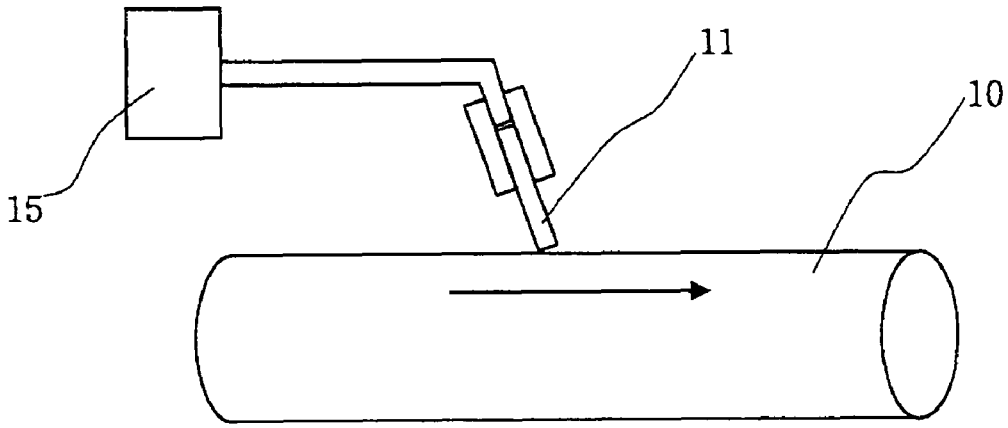
FIG. 3 is a schematic illustrative view showing a measuring apparatus for friction resistance (a surface property measuring apparatus) used in the examples.

The occurrence of filming on the surface of the photosensitive drum 10 after 100,000 revolutions was confirmed visually. The extent of friction resistance on the surface of the photosensitive drum 10 with respect to the urethane blade after 100,000 revolutions was obtained in terms of a relative value based on the extent of friction resistance (1.0) of a surface of a conventional photosensitive drum (having no surface protective layer in Comparative Example 5). The measurement of the friction resistance was carried out by using a surface property measuring apparatus (HEIDON-14DR, produced by Shinto Kagaku Co., Ltd.) shown in FIG. 3. In FIG. 3, symbol 15 denotes a load detector.

TABLE 2

| | Friction resistance value | | Film | |
|---|---|---|---|---|
| | Before running | After running | scratched amount (μm) | Occurrence of filming |
| Example 1 | 0.6 | 0.6 | 0.6 | not occurred |
| Example 2 | 0.5 | 0.6 | 0.4 | not occurred |
| Example 3 | 0.5 | 0.5 | 0.5 | not occurred |
| Example 4 | 0.6 | 0.6 | 0.5 | not occurred |
| Example 5 | 0.6 | 0.7 | 0.4 | not occurred |
| Example 6 | 0.5 | 0.5 | 0.5 | not occurred |
| Example 7 | 0.4 | 0.4 | 0.4 | not occurred |
| Example 8 | 0.4 | 0.4 | 0.4 | not occurred |
| Example 9 | 0.5 | 0.6 | 0.5 | not occurred |
| Example 10 | 0.4 | 0.5 | 0.4 | not occurred |
| Example 11 | 0.6 | 0.6 | 0.8 | not occurred |
| Example 12 | 0.6 | 0.5 | 0.9 | not occurred |
| Example 13 | 0.6 | 0.6 | 0.9 | not occurred |
| Example 14 | 0.6 | 0.6 | 0.5 | not occurred |
| Example 15 | 0.6 | 0.6 | 0.4 | not occurred |
| Example 16 | 0.4 | 0.4 | 0.4 | not occurred |
| Comparative Example 1 | 1.0 | 0.9 | 1.0 | occurred |
| Comparative Example 2 | 0.6 | 0.8 | 0.9 | occurred |
| Comparative Example 3 | 0.8 | 0.8 | 0.9 | not occurred |
| Comparative Example 4 | 0.4 | 0.8 | 1.0 | occurred |
| Comparative Example 5 | 1.0 | 0.9 | 1.4 | not occurred |

It is understood from the results shown in Table 2 that the photoreceptors of Examples 1 to 15 according to the invention have friction resistance values of from 0.4 to 0.6, which are maintained after running (100,000 revolutions), to maintain good lubricating property stably. On the other hand, the photoreceptors of Comparative Examples 1 to 3 having no microcapsule having a lubricating oil encompassed therein added, and the photoreceptor of Example 5 having no surface protective layer provided have large friction resistance values of from 0.9 to 1.0, and the photoreceptor of Comparative Example 4 having a lubricating oil added as it is has a friction resistance value that is increased to 0.8 after running while it is as small as 0.4 before running. Accordingly, it is confirmed from the results that the addition of the microcapsules having a lubricating oil encompassed therein is effective for stable maintenance of lubricating property upon repeated use.

The photoreceptors of Comparative Examples 1, 2 and 4 suffer filming, and the photoreceptor of Comparative Example 5 suffers a large film scratched amount while no filming occurs. On the other hand, the photoreceptors of Examples 1 to 15 according to the invention containing the microcapsules having a lubricating oil encompassed therein undergo small film scratched amounts and no filming, and thus it is confirmed that the addition of the microcapsules having a lubricating oil encompassed therein is effective for improvement in printing durability and image quality.

INDUSTRIAL APPLICABILITY

As described in the foregoing, according to the invention, an electrophotographic photoreceptor is provided that is excellent in lubricating property, has a surface hardly scratched and damaged, prevents an image defect due to filming or the like from occurring, is good in toner releasing property, and has high durability. The electrophotographic photoreceptor of the invention is useful for an image forming apparatus using an electrophotographic system, such as a printer, a copying machine and a facsimile machine.

What is claimed is:

1. An electrophotographic photoreceptor, comprising:

an electroconductive substrate; and at least a photosensitive layer provided on the electroconductive substrate, wherein the electrophotographic photoreceptor has an outermost layer which contains microcapsules having a lubricating oil encompassed therein.

2. The electrophotographic photoreceptor as claimed in claim 1, wherein the microcapsules comprise inorganic porous particles.

3. The electrophotographic photoreceptor as claimed in claim 2, wherein the inorganic porous particles are hollow.

4. The electrophotographic photoreceptor as claimed in claim 2, wherein the inorganic porous particles are porous silica particles.

5. The electrophotographic photoreceptor as claimed in claim 1, wherein the microcapsules comprise an organic polymer material.

6. The electrophotographic photoreceptor as claimed in claim 5, wherein the organic polymer material is one of a melamine resin or a polystyrene resin.

7. The electrophotographic photoreceptor as claimed in claim 1, wherein the lubricating oil is a silicone oil.

8. The electrophotographic photoreceptor as claimed in claim 7, wherein the silicone oil is one of a dimethyl silicone oil or a methyl phenyl silicone oil.

9. The electrophotographic photoreceptor as claimed in claim 1, wherein the lubricating oil is a fluorine oil.

10. The electrophotographic photoreceptor as claimed in claim 9, wherein the fluorine oil is a fluoroether oil.

11. The electrophotographic photoreceptor as claimed in claim 1, further comprising a surface protective layer provided as the outermost layer on the photosensitive layer.

12. The electrophotographic photoreceptor as claimed in claim 11, wherein the surface protective layer contains a hardening resin.

13. The electrophotographic photoreceptor as claimed in claim 12, wherein the hardening resin is one of an epoxy resin, a urethane resin, or a hardened product of a cyanate ester.

14. The electrophotographic photoreceptor as claimed in claim 13, wherein the epoxy resin is an alkoxy group-containing silane-modified epoxy resin.

15. The electrophotographic photoreceptor as claimed in claim 14, wherein the alkoxy group-containing silane-modified epoxy resin has a structure represented by general formula (1) or (2):

(1)

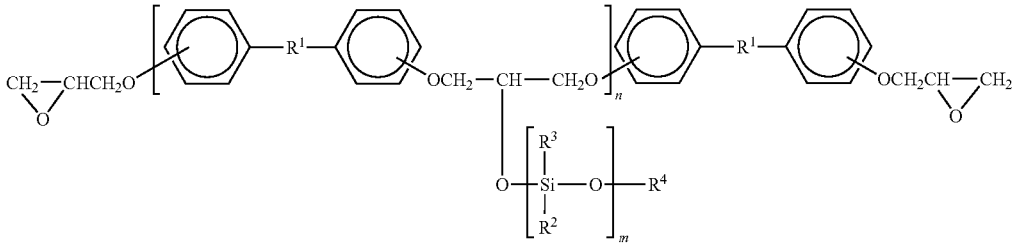

wherein $R^1$ represents $CH_2$, $C(CH_3)_2$, $CH(CH_3)$, $C(CF_3)_2$, O, $SO_2$ or S; $R^2$ and $R^3$ each independently represents an alkoxy group having from 1 to 3 carbon atoms or an alkyl group having 1 or 2 carbon atoms; $R^4$ represents an alkyl group having 1 or 2 carbon atoms; n represents an integer of from 0 to 100; and m represents an integer of from 1 to 20, (2)

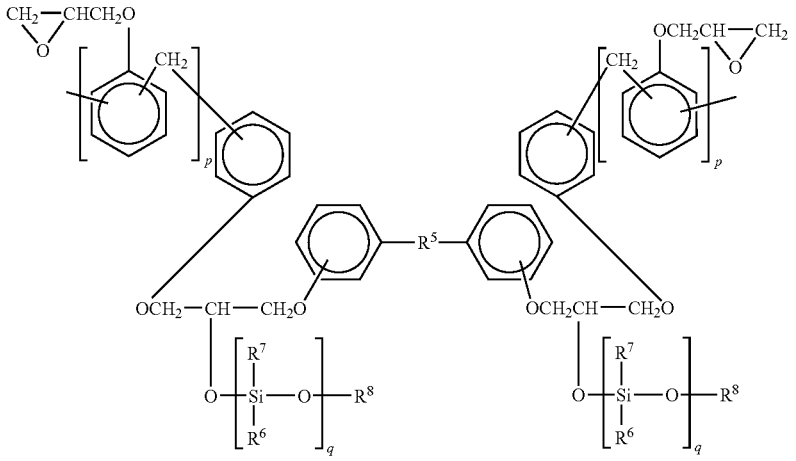

wherein $R^5$ represents $CH_2$, $C(CH_3)_2$, $CH(CH_3)$, $C(CF_3)_2$, O, $SO_2$ or S; $R^6$ and $R^7$ each independently represents an alkoxy group having from 1 to 3 carbon atoms or an alkyl group having 1 or 2 carbon atoms; $R^8$ represents an alkyl group having 1 or 2 carbon atoms; p represents an integer of from 0 to 100; and q represents an integer of from 1 to 20.

16. The electrophotographic photoreceptor as claimed in claim 14, wherein the alkoxy group-containing silane-modified epoxy resin is a hardened product of a hybrid material of an epoxy resin with an alkoxysilane, and wherein the hybrid material contains from 10 to 50% by weight of the alkoxysilane.

17. The electrophotographic photoreceptor as claimed in claim 13, wherein the hardened product of a cyanate ester is a polymer obtained by hardening a cyanate ester compound represented by the following general formula (3):

$$R^9\text{+O—C}\equiv\text{N]}_r \quad (3)$$

wherein $R^9$ represents an aromatic organic group; and r represents an integer of 2 or 3.

18. The electrophotographic photoreceptor as claimed in claim 13, wherein the urethane resin contains a fluorine-containing polyol.

19. The electrophotographic photoreceptor as claimed in claim 11, wherein the surface protective layer contains at least one of a reinforcing filler and a conductivity adjusting agent.

20. The electrophotographic photoreceptor as claimed in claim 1, wherein the photosensitive layer comprises a plurality of layers including a charge generation layer and a charge transport layer laminated together, and wherein the charge transport layer is the outermost layer of the electrophotographic photoreceptor.

21. The electrophotographic photoreceptor as claimed in claim 1, wherein the photosensitive layer comprises a single layer containing a charge generating substance and a charge transporting substance, and wherein the photosensitive layer is the outermost layer of the electrophotographic photoreceptor.

* * * * *